US011851853B2

(12) United States Patent
Sherlock

(10) Patent No.: US 11,851,853 B2
(45) Date of Patent: Dec. 26, 2023

(54) WAKE UP SYSTEM TO ALLOW REMOTE MACHINE CONFIGURATION OF A WORK MACHINE

(71) Applicant: Deere & Company, Moline, IL (US)

(72) Inventor: Lance R. Sherlock, Asbury, IA (US)

(73) Assignee: Deere & Company, Moline, IL (US)

( * ) Notice: Subject to any disclaimer, the term of this patent is extended or adjusted under 35 U.S.C. 154(b) by 221 days.

(21) Appl. No.: 16/654,860

(22) Filed: Oct. 16, 2019

(65) Prior Publication Data

US 2021/0115650 A1 Apr. 22, 2021

(51) Int. Cl.
*E02F 9/26* (2006.01)
*E02F 9/20* (2006.01)

(52) U.S. Cl.
CPC ..... *E02F 9/265* (2013.01); *E02F 9/205* (2013.01); *G05D 2201/0202* (2013.01)

(58) Field of Classification Search
CPC ... E02F 9/265; E02F 9/205; G05D 2201/0202
See application file for complete search history.

(56) References Cited

U.S. PATENT DOCUMENTS 6,956,467 B1 * 10/2005 Mercado, Jr. ..... B60R 25/042 340/425.5
9,809,956 B1 * 11/2017 Sherlock ..... E02F 3/844
10,166,948 B2 1/2019 Kang
2006/0211400 A1 * 9/2006 Bauman ..... H04M 11/007 455/343.1
2014/0176456 A1 * 6/2014 Yoon ..... G09G 3/2092 345/173
2014/0274226 A1 * 9/2014 Pandya ..... G07C 5/008 455/574
2018/0210722 A1 7/2018 Mori
2018/0334138 A1 * 11/2018 Namineni ..... B60R 25/246
2018/0349157 A1 * 12/2018 Ahmed ..... G06F 8/65
2021/0089294 A1 * 3/2021 Urawaki ..... H03M 7/6005

FOREIGN PATENT DOCUMENTS

DE 102006010988 A1 9/2006
DE 102014204512 A1 9/2014
DE 102018113209 A1 12/2018

OTHER PUBLICATIONS

German Search Report issued in counterpart application No. 102020211440.4 dated Apr. 29, 2021 (10 pages).

* cited by examiner

*Primary Examiner* — Tyler J Lee
*Assistant Examiner* — Yufeng Zhang
(74) *Attorney, Agent, or Firm* — Joseph R. Kelly; Kelly, Holt & Christenson PLLC

(57) ABSTRACT

A local operator-controlled work machine receives a wake-up call when it is not running. The wake-up call turns on a user interface in the machine. A remote machine configuration system loads a job file onto the machine and the machine turns off again.

13 Claims, 9 Drawing Sheets

WAKE UP SYSTEM TO ALLOW REMOTE MACHINE CONFIGURATION OF A WORK MACHINE

FIELD OF THE DESCRIPTION

The present description relates to controlling equipment. More specifically, the present description relates to waking up a work machine to remotely configure the settings of the work machine.

BACKGROUND

There are a wide variety of different types of equipment, such as construction equipment, turf care equipment, forestry equipment and agricultural equipment. These types of equipment are operated by an operator. For instance, a work machine is operated by an operator, and it has many different mechanisms that are controlled by the operator in performing an operation. At the beginning of a work shift, an operator often needs to load new settings or change the configuration of the equipment for that shift of work.

For construction equipment, an operator often does this by loading a job file into the work machine. A job file includes the mapping of a worksite and may include the geographical, grading, and other specific information at a job site. The information in the job file is used to make the specific settings and/or configurations of the equipment so that it performs the specific job as desired.

Because of the complex nature of the work machine, it can be difficult and time consuming to load the daily settings or configurations of the work machine. There can be down time while a job file with the daily settings are loaded into the work machine. Also, particularly with new operators, there is room for error in loading the job files. Given widely varying types of conditions that can be encountered by a work machine and given a wide range of different types of work machines, the down time and the error possibilities for an entire worksite can be large.

The discussion above is merely provided for general background information and is not intended to be used as an aid in determining the scope of the claimed subject matter.

SUMMARY

A local operator-controlled work machine receives a wake-up call when it is not running. The wake-up call turns on a user interface in the machine. A remote machine configuration system loads a job file onto the machine and the machine turns off again.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Local operator-controlled work machines are machines that are operated by an operator local to the machine (such as an operator in an operator compartment of the machine). The operator configures the work machines and enters different settings in order to perform operations with the work machine. In many cases, the operations take multiple days or shifts and the operator must reconfigure the machine or re-enter the settings at the beginning of each day or shift. Even in the case where the machine remembers its configuration or settings, conditions can change meaning that the operator must enter new settings or configure the machine in a new way. This operation can be time consuming and error prone. One example will be described, but it is an example only.

Many different types of work machines perform daily operations that often require new settings or configurations. Dozers or graders and other earth moving machines, for example, have grade control systems. A grade control system receives a job file that may identify final (or target) grade values for different locations at a job site. The job file may be used to display, for an operator, where earth still needs to be removed, and where it needs to be filled, in order to reach a final (or target) grade. Other grade control systems provide more automation. They can, for example, automate the lift and tilt angles of the ground engaging elements (such as the blade) of the earth moving machine, based on the job file.

However, conditions at a job site often change, leading to design changes, which themselves, lead to changes in the job file. For instance, an earth moving machine may encounter rock. It may be extremely expensive to move rock, so, instead, the design may be changed (the final grade or a trench location, etc. is changed) to accommodate the rock. This often leads to a change in the job file. Thus, the next time the machine is used, the new job file must be loaded into the grade control system on the machine.

A local operator-controlled work machine with grade control, after performing an operation during a shift, may be turned off and sit dormant. The present description thus proceeds with respect to a system that detects changes to a job file and wakes a machine up, when it is dormant, and loads the job file at the time. This saves time when the machine is next powered up because the new job file will have already been loaded. It is also less error prone than having an operator attempt to load the new job file. Improvement is even greater with a fleet of machines.

Figure 1:
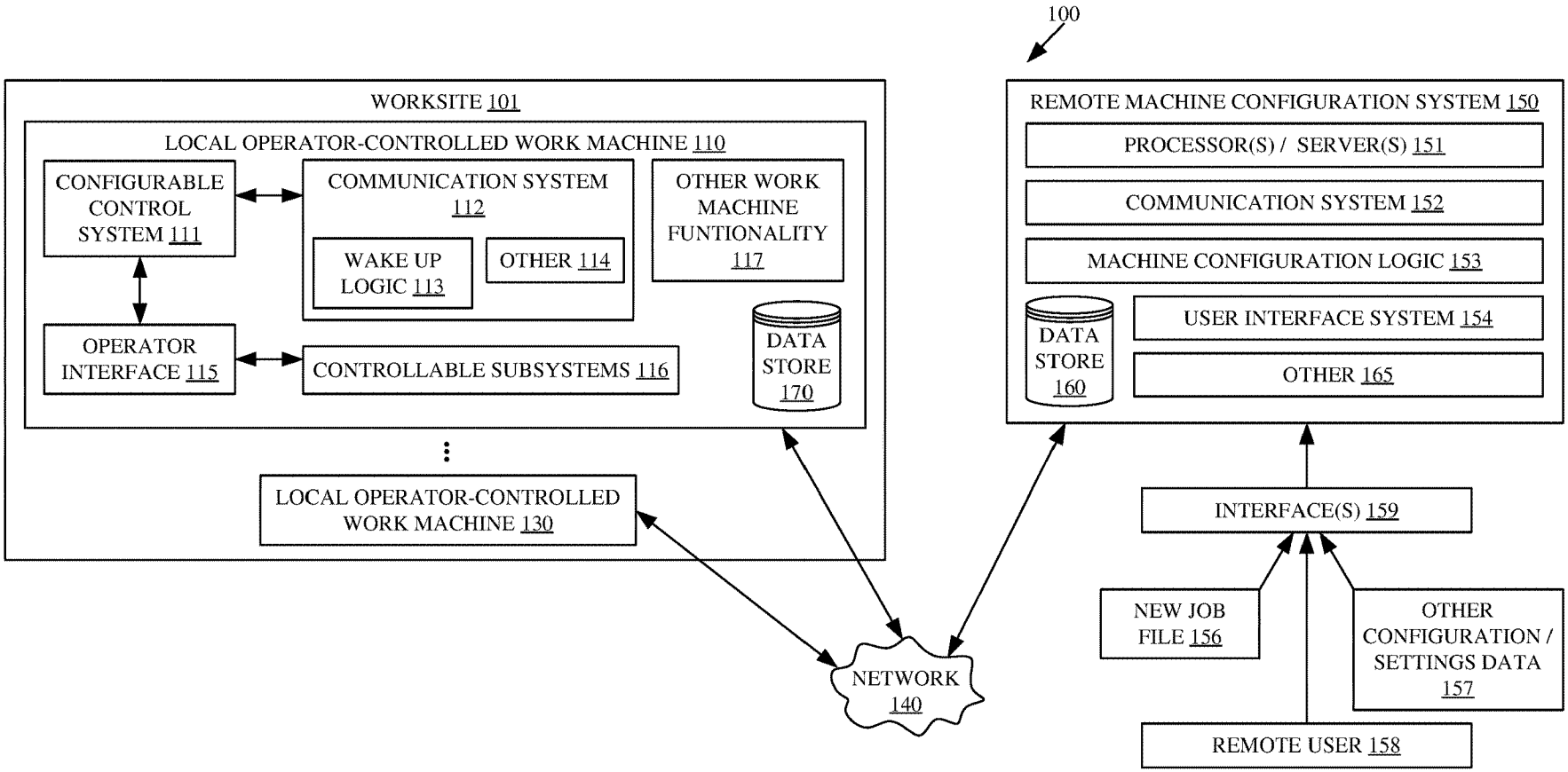
FIG. 1 is a block diagram showing an example of a remote machine configuration system and an example of a worksite with work machines.

FIG. 1 is a block diagram showing an example architecture 100 that includes a worksite 101 that includes one or more local operator-controlled work machines 110-130 coupled for communication with remote machine configuration system 150, over network 140. Network 140 can be any of a wide variety of different types of networks, such as a wide area network, a local area network, a near field communication network, a cellular network, or any of a wide variety of other networks or combinations of networks. It is contemplated that remote machine configuration system 150 can also communicate with other work machines over network 140. Architecture 100 shows that system 150 can also generate interface(s) 159. Remote user 158 can interact with interfaces 159 to control and manipulate remote machine configuration system 150. User 158, for example, may be a worksite manager that remotely manages multiple machines 110-130 at the worksite 101. Before describing the items in architecture 100 in more detail, the overall operation of architecture 100 will be described.

For purposes of the present description, it will be assumed that machines 110-130 are earth moving machines with automatic grade control systems that can be configured with a job file. It will be further assumed that at some point, the worksite design changes so a new job file needs to be loaded into the automatic grade control systems on machines 110-130. Recall that in current systems, this is done by the operators of the machines, at the beginning of the day or shift. The machine 110-130 are turned on and then sit idle while the new job file is loaded. This can be time consuming and error prone. The ineffectiveness and errors are exacerbated when the fleet of machines is larger. The present description will proceed with respect to loading the new job file into machine 110, but it can be used to load it into machine 130 as well.

It is first assumed that local operator-controlled work machine 110 is shutdown at the end of a workday (or shift) and that its operator has left the worksite 101. Remote user 158 can generate an input with the new job file 156 or other configuration/settings data 157, and input that information into system 150 through interface(s) 159. Remote machine configuration system 150 illustratively receives the input from interface(s) 159 and generates and sends an update call to work machine 110 over network 140. Work machine 110 receives the update call, and based on the update call, generates a wakeup signal to wake up the operator interface of work machine 110. User 158 can then interact with work machine 110, through remote machine configuration system 150, or system 150 can be configured to automatically send control data to work machine 110 based on the new job file 156 or any other configuration or settings data 157. System 150 sends the new job file 156 to machine 110 along with any other configuration or settings data 157. Work machine 110 stores the received new job file 156, and/or other configuration/settings data 157 for later use. Work machine 110 can then power down again. When the local operator of machine 110 arrives in the morning, the new job file 156 and/or configuration or settings data 157 are already loaded on machine 110, and the operator need not perform those steps. The control system (e.g. automatic grade control system) or machine 110 can then control the work machine 110 based on the newly received, stored data. The items in architecture 100 will now be described in more detail.

As shown in FIG. 1, in addition to the items described above, remote machine configuration system 150 illustratively includes one or more processors/servers 151, communication system 152, machine configuration logic 153, user interface system 154, data store 160, and it can include a variety of other items 165.

User interface system 154 illustratively generates interface(s) 159 so that remote user 158 can interact with remote machine configuration system 150. System 154 detects user interactions with interfaces 159 and generates an indication of those interactions for other items in system 150. User 158 may input or generate new job file 156, and/or other configuration/settings data 157 through interface(s) 159.

Based on the new job file 156 and/or configuration/setting data 157, machine configuration logic 153 generates configuration signals that are sent to work machine 110. The signals can represent the new job file and/or the new configuration/settings data and they can be control signals that control machine 110 to wake up and store the new data. Data store 160 can illustratively store the new job files or other data, as well as past data on system 150.

Communication system 152 illustratively enables the communication of the signals generated by machine configuration logic 153 from the remote machine configuration system 150 to the local operator-controlled work machine 110 through network 140. Communication system 152 may also communicate with machine 110 in other ways.

Local operator-controlled work machine 110 illustratively includes configurable control system 111, communication system 112, operator interface 115, controllable subsystems 116 and data store 170. It can include other work machine functionality 117 as well. Machines 110 and 130 can be similar or different. In the present description, they are assumed to be similar so that only machine 110 is described in more detail.

Communication system 112 is communicatively coupled to network 140, for communication with system 150. Communication system 112, itself, illustratively includes wake-up logic 113 and a wide variety of other items or functionality 114. When communication system 152 sends signals generated by machine configuration logic 153, to load a new job file into machine 110, wake-up logic 113 illustratively generates a wake-up signal and provides it to configurable control system 111 to turn on or wake-up the system.

Controllable subsystems can illustratively include a subsystem that controls operator interface 115, a propulsion subsystem, a steering subsystem, a ground engaging element, a positioning subsystem (e.g. blade lift and tilt actuators), and a wide variety of other subsystems used by the work machine 110. Those mentioned are examples only.

In the example discussed herein, configurable control system 111 is an automatic grade control system that operates based on a job file. However, it can be any system that receives machine configuration or settings data that is used to configure a controllable machine that has a local operator. Configurable control system 111 illustratively receives the wake-up signal from communication system 112, powers itself up, and wakes up the operator interface 115. This allows remote user 158 to access the machine 110.

Operator interface 115 can include a display device, or an audio, haptic, visual or other device(s). Once it is powered up, operator interface 115 can be locally or remotely controlled and can be used to configure configurable control system 111. For example, once the operator interface 115 is powered up (or woken up), remote machine configuration system 150 can communicate with it over network 140 to load the new job file 156 and/or other data 157 to configure the configurable control system 111. Therefore, remote machine configuration system 150 illustratively controls configurable control system 111 to receive the new job file 156 and/or the configuration/settings data 157, without the operator of machine 110 needing to be present. Configurable control system 111 can then use that data to control controllable subsystems 116 the next time it is used by the operator.

Figure 2:
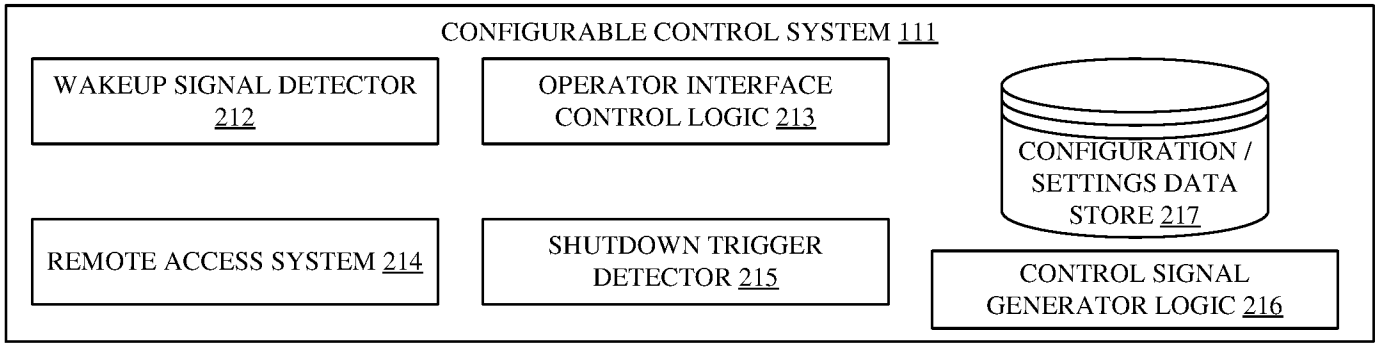
FIG. 2 is a block diagram showing an example of a configurable control system on a work machine in more detail.

FIG. 2 is a block diagram showing an example of a configurable control system 111 on work machine 110, in more detail. Configurable control system 111 illustratively includes wakeup signal detector 212, operator interface control logic 213, remote access system 214, shutdown trigger detector 215, control signal generator logic 216, and configuration/settings data store 217. As discussed above, configurable control system 111 receives a wakeup signal from wakeup logic 113 in communication system 112, indicating that user 158 (or system 150) is attempting to input a new job file 156, and/or other configuration/settings data 157.

Wakeup signal detector 212 illustratively detects the wakeup signal, generated from wakeup logic 113 in communication system 112, from the update call received from remote machine configuration system 150. Wakeup signal detector 212 sends the wakeup signal to operator interface control logic 213 which can illustratively wakeup the operator interface 115 on work machine 110.

Remote access system 214 illustratively allows remote access to user 158 through the operator interface 115. This allows user 158 to input the new job file 156, and/or other configuration/settings data 157 into configurable control system 111, as if the user 158 were local to machine 110 and interacting with the operator interface 115.

Shutdown trigger detector 215 illustratively detects when a shutdown trigger has been generated. Shutdown triggers include time lapse signals, shutdown control signals, or a variety of other shutdown signals, indicating to the configurable control system 111, that the new job file 156, and/or other configuration/settings data 157 has been received and stored in configuration/settings data store 217, and that the configurable control system 111 is ready to be shutdown, or put back into sleep mode. Local operator-controlled work machine 110 can then be back to sleep or shutdown.

Control signal generator logic 216 is illustratively configured to generate control signals to control the controllable subsystems 116 when the operator turns on the work machine 110. Control signal generator logic 216 accesses the data store 217 when the work machine 110 turns on, to read the data and control the controllable subsystems 116, based on that data. Control signal generator logic 216 thus generates control signals based on the new job file 156, and/or other configuration/settings data 157, that was remotely loaded into configurable control system 111.

Figure 3A:
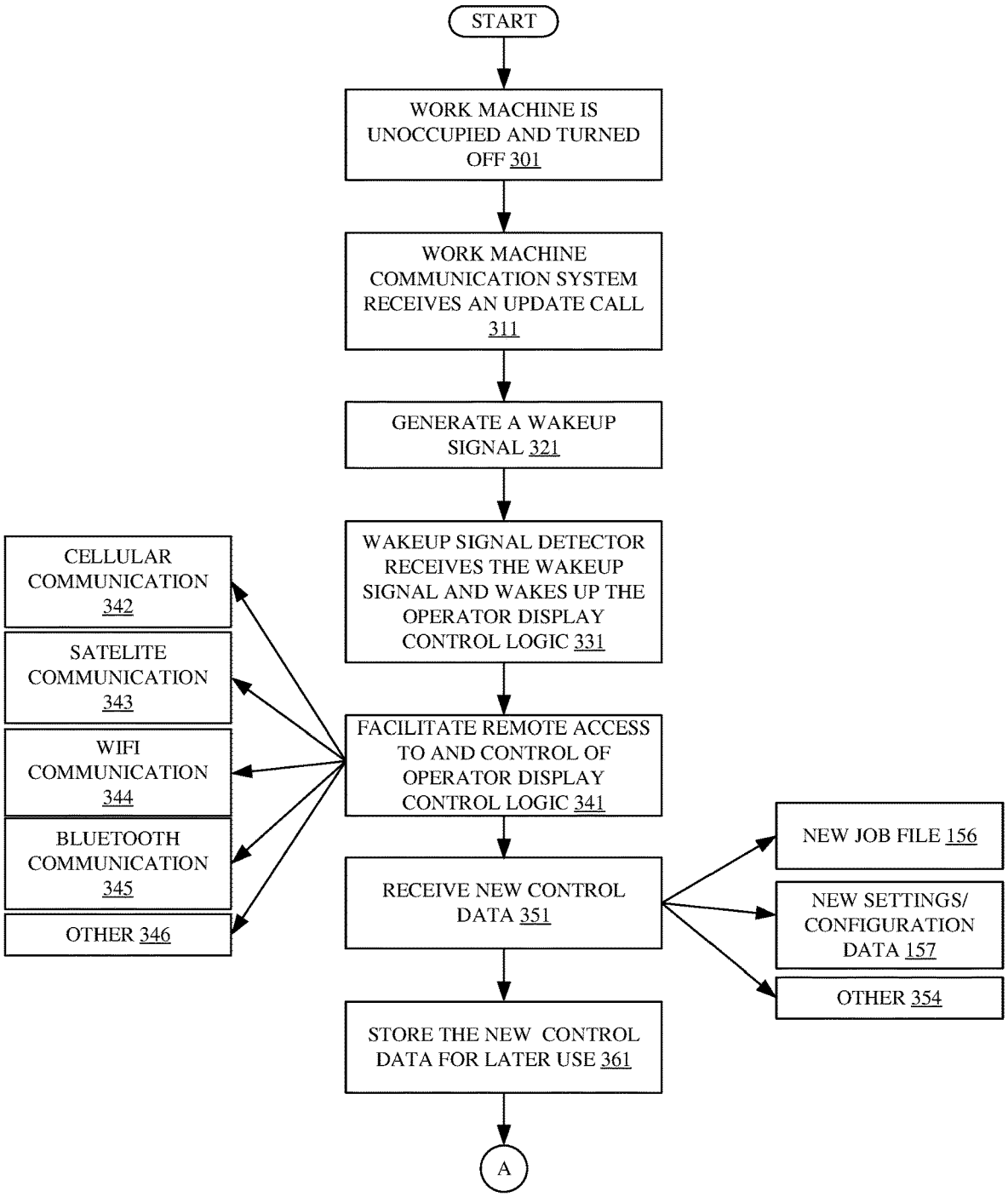
FIGS. 3A and 3B illustrate a flow diagram showing one example of controlling the configuration/settings of a work machine beginning when the work machine is off.
Figure 3B:
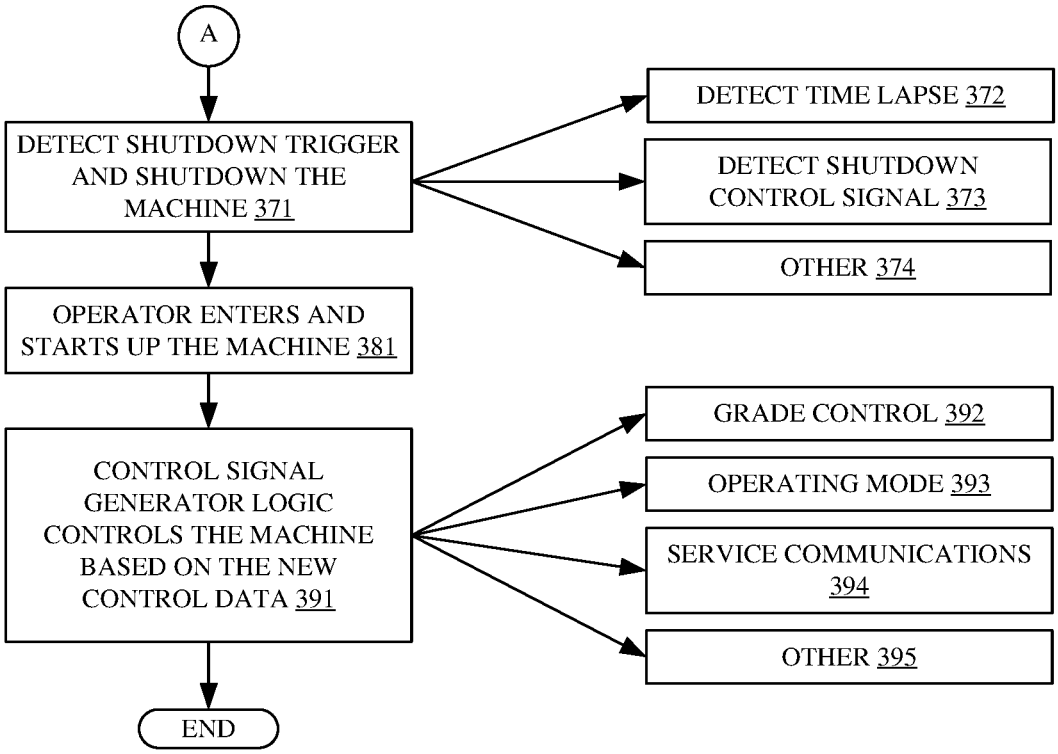

FIGS. 3A and 3B (collectively referred to herein as FIG. 3) illustrate a flow diagram showing one example of loading the job file 156, or configuration/settings 157 of an example work machine 110 beginning when the work machine 110 is sleeping. For purposes of the present description, when machine 110 is described as being "sleeping" or "asleep", it is meant that at least the operator interface functionality is turned off.

It is first assumed that work machine 110 is unoccupied and turned off or asleep. This may be, for example, at night or between shifts. This is indicated by block 301 in the flow diagram of FIG. 3. For the purpose of this figure, local operator-controlled work machine 110 is used as an example work machine, and reference is made to FIGS. 1 and 2, using similar reference numbers.

Communication system 112 on work machine 110 illustratively receives an update call from remote machine configuration system 150, over network 140. This is indicated by block 311. The update call indicates that system 150 is going to update the control data (e.g., job file 156, and/or configuration/settings data 157) on machine 110 because new or modified data has been detected or input at system 150. Wakeup logic 113, on communication system 112, generates a wakeup signal in response to receiving the update call. This is indicated by block 321. Wakeup signal detector 212, on configurable control system 111, receives the wakeup signal generated by logic 113 and wakes up (or powers up—e.g., turns on) the operator interface control logic 213. This is indicated by block 331.

Remote access system 214 then facilitates remote access to operator interface control logic 213. This is indicated by block 341 and can be done in a variety of different ways. For instance, remote access system 214 can facilitate cellular access, in which case user 158 (or machine configuration logic 153) may control communication system 152 to send the new job file 156 and/or data 157 to work machine 110 using cellular communication. This is indicated by block 342. Remote access system 214 can also facilitate access using satellite communication, in which user 158 (or machine configuration logic 153) can control communication system 152 to contact work machine 110 via satellite communication. This is indicated by block 343. Similarly, remote access system 214 can facilitate Wi-Fi access as indicated by block 344, or Bluetooth access, as indicated by block 345. System 214 can facilitate other types of access to work machine 110 in a variety of other ways as well. This is indicated by block 346.

Operator display control logic 213 then receives the new control data from remote machine configuration system 150. This is indicated by block 351. This can be a wide variety of different data. For instance, it may be the new job files. This is indicated by block 156. It may be new configuration/settings data. This is indicated by block 157. It may be a variety of other data. This is indicated by block 354. The new control data is stored for later use, in configuration/settings data store 217. This is indicated by block 361.

After the data is stored, shutdown trigger detector 215 can detect a shutdown trigger and the machine 110 may be shutdown. This is indicated by block 371. This may be done in a variety of different ways. For instance, a time lapse may be detected as the shutdown trigger. This is indicated by block 372. For example, after a pre-defined period (e.g., twenty minutes) where the user interface on machine 100 is not used, then detector 215 on the work machine 110 may illustratively, automatically shutdown machine 110. Shutdown trigger detector 215 can detect a shutdown control signal received from remote machine configuration system 150, directing the machine 110 to shutdown and then shut down machine 110. This is indicated by block 373. Work machine 110 may be shutdown a variety of other ways. This is indicated by block 374.

Work machine 110 now has new control data (e.g., a new job file 156, and/or new configuration/settings data 157) stored, and it is shutdown. An operator may now arrive at the worksite 101, enter and start up the machine 110. This is indicated by block 381. Control signal generator logic 216 illustratively accesses data store 217 and generates control signals to control the controllable subsystems 116 on machine 110, based on the new control data (e.g., the new job file 156, and/or new configuration/settings data 157). This is indicated by block 391.

The machine may be controlled in a variety of different ways. For instance, the controllable subsystems 116 may include a grade control system that can be controlled using the new grade control map or other configuration/settings data. This is indicated by block 392. The new setting data 157 may indicate a specific operating mode (such as a fuel efficiency mode) and control signal generator 216 can control the work machine 110 to be more fuel efficient. This is indicated by block 393. Control signal generator logic 216 can also control communication system 112 on machine 110 so that it sends service communications to service vendors.

This is indicated by block 394. A wide variety of other control signals can be generated by control signal generator logic 216 to control machine 110 in a wide variety of other ways as well. This is indicated by block 395.

The present discussion has mentioned processors and servers. In one example, the processors and servers include computer processors with associated memory and timing circuitry, not separately shown. They are functional parts of the systems or devices to which they belong and are activated by and facilitate the functionality of the other components or items in those systems.

Also, several user interface displays have been discussed. They can take a wide variety of different forms and can have a wide variety of different user actuatable input mechanisms disposed thereon. For instance, the user actuatable input mechanisms can be text boxes, check boxes, icons, links, drop-down menus, search boxes, etc. They can also be actuated in a wide variety of different ways. For instance, they can be actuated using a point and click device (such as a track ball or mouse). They can be actuated using hardware buttons, switches, a joystick or keyboard, thumb switches or thumb pads, etc. They can also be actuated using a virtual keyboard or other virtual actuators. In addition, where the screen on which they are displayed is a touch sensitive screen, they can be actuated using touch gestures. Also, where the device that displays them has speech recognition components, they can be actuated using speech commands.

A number of data stores have also been discussed. It will be noted they can each be broken into multiple data stores. All can be local to the systems accessing them, all can be remote, or some can be local while others are remote. All of these configurations are contemplated herein.

It will be noted that the above discussion has described a variety of different systems, components and/or logic. It will be appreciated that such systems, components and/or logic can be comprised of hardware items (such as processors and associated memory, or other processing components, some of which are described below) that perform the functions associated with those systems, components and/or logic. In addition, the systems, components and/or logic can be comprised of software that is loaded into a memory and is subsequently executed by a processor or server, or other computing component, as described below. The systems, components and/or logic can also be comprised of different combinations of hardware, software, firmware, etc., some examples of which are described below. These are only some examples of different structures that can be used to form the systems, components and/or logic described above. Other structures can be used as well.

Also, the figures show a number of blocks with functionality ascribed to each block. It will be noted that fewer blocks can be used so the functionality is performed by fewer components. Also, more blocks can be used with the functionality distributed among more components.

Figure 4:
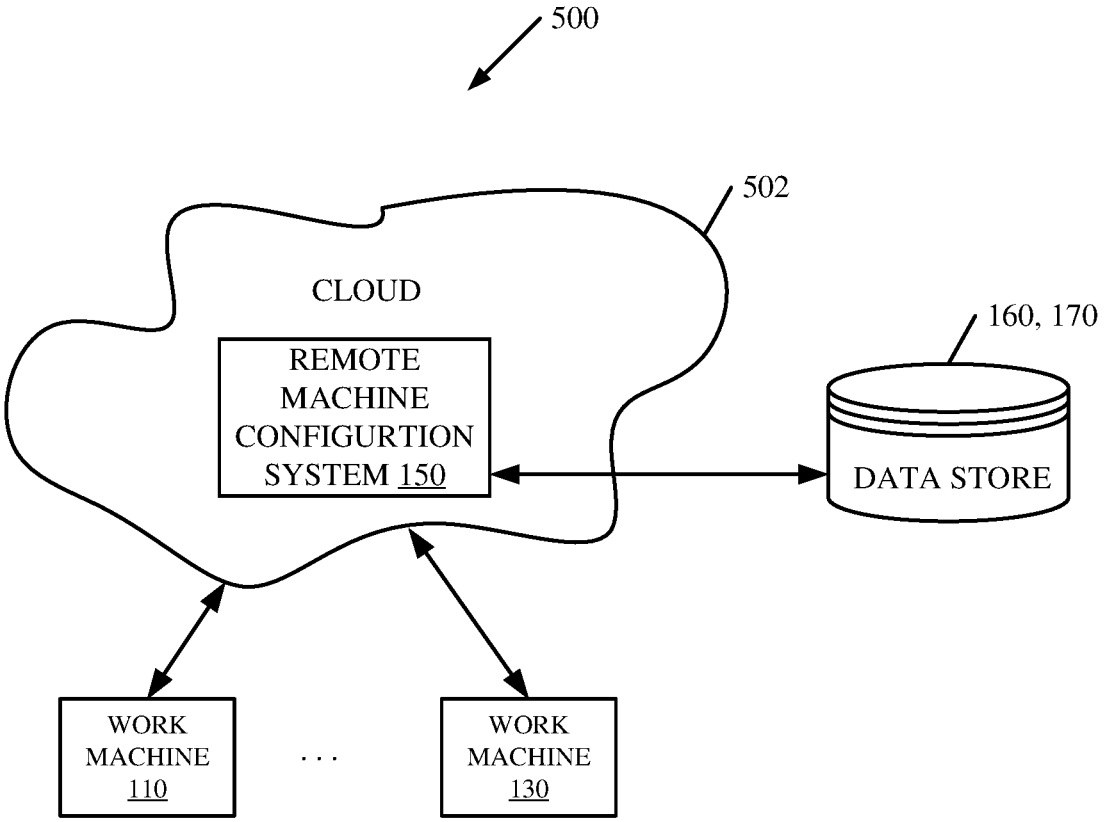
FIG. 4 is a block diagram showing one example of the architecture illustrated in FIG. 1, deployed in a remote server architecture.

FIG. 4 is a block diagram showing one example of the architecture illustrated in FIG. 1, deployed in a remote server architecture 500. In an example, remote server architecture 500 can provide computation, software, data access, and storage services that do not require end-user knowledge of the physical location or configuration of the system that delivers the services. In various examples, remote servers can deliver the services over a wide area network, such as the internet, using appropriate protocols. For instance, remote servers can deliver applications over a wide area network and they can be accessed through a web browser or any other computing component. Software or components shown in FIG. 1 as well as the corresponding data, can be stored on servers at a remote location. The computing resources in a remote server environment can be consolidated at a remote data center location or they can be dispersed. Remote server infrastructures can deliver services through shared data centers, even though they appear as a single point of access for the user. Thus, the components and functions described herein can be provided from a remote server at a remote location using a remote server architecture. Alternatively, they can be provided from a conventional server, or they can be installed on client devices directly, or in other ways.

In the examples shown in FIG. 4, some items are similar to those shown in FIG. 1 and they are similarly numbered. FIG. 4 specifically shows that remote machine configuration system 150 can be located at a remote server location 502. Therefore, work machines 110-130 accesses those systems through remote server location 502.

FIG. 4 also depicts another example of a remote server architecture. FIG. 4 shows that it is also contemplated that some elements of FIG. 1 are disposed at remote server location 502 while others are not. By way of example, data stores 160,170 can be disposed at a location separate from location 502 and accessed through the remote server at location 502. Regardless of where they are located, they can be accessed directly by work machines 110-130, through a network (either a wide area network or a local area network), they can be hosted at a remote site by a service, or they can be provided as a service, or accessed by a connection service that resides in a remote location. All of these architectures are contemplated herein.

It will also be noted that the elements of FIG. 1, or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 5:
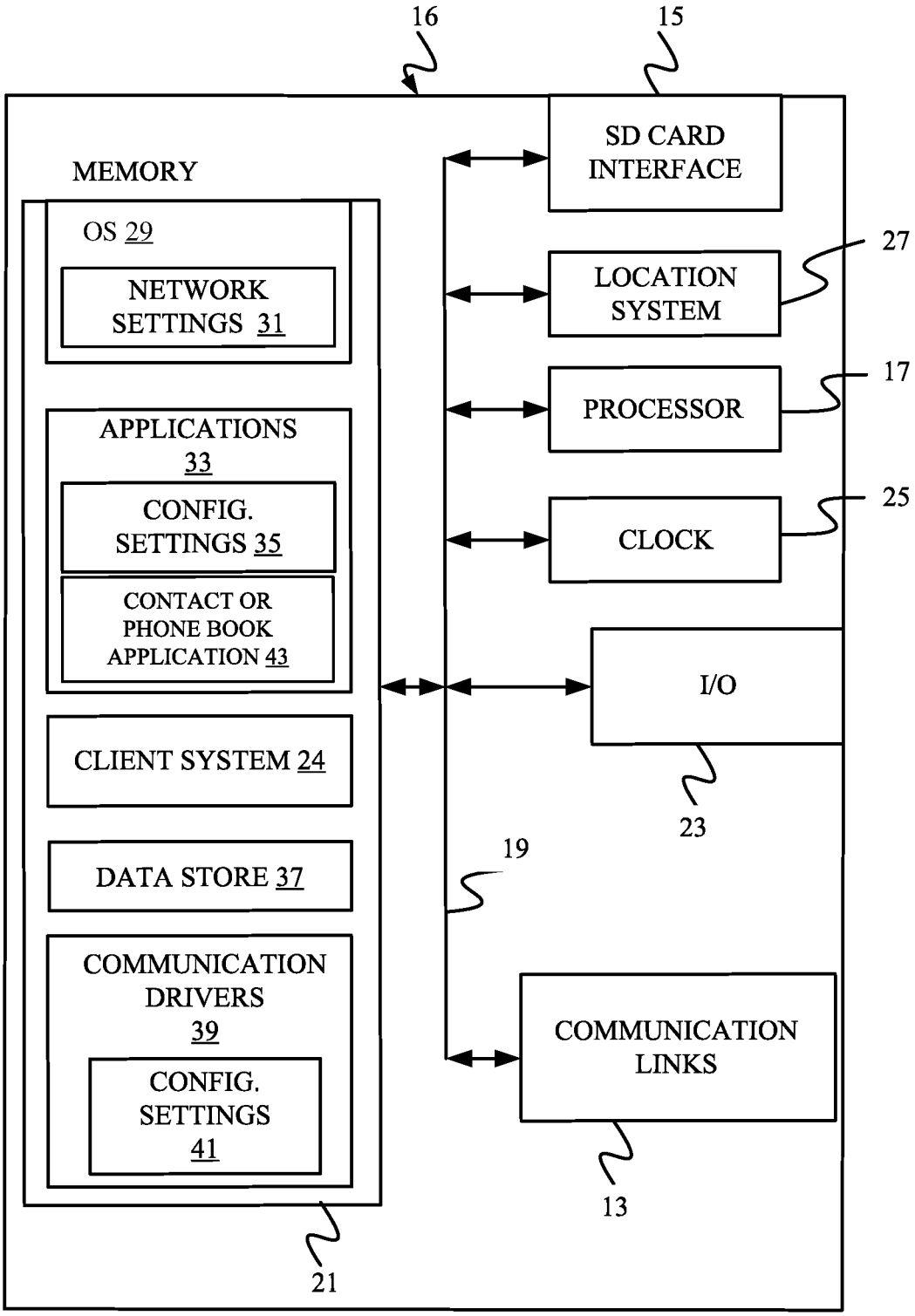
FIGS. 5-7 show examples of mobile devices that can be used in the architectures shown in the previous figures.
Figure 6:
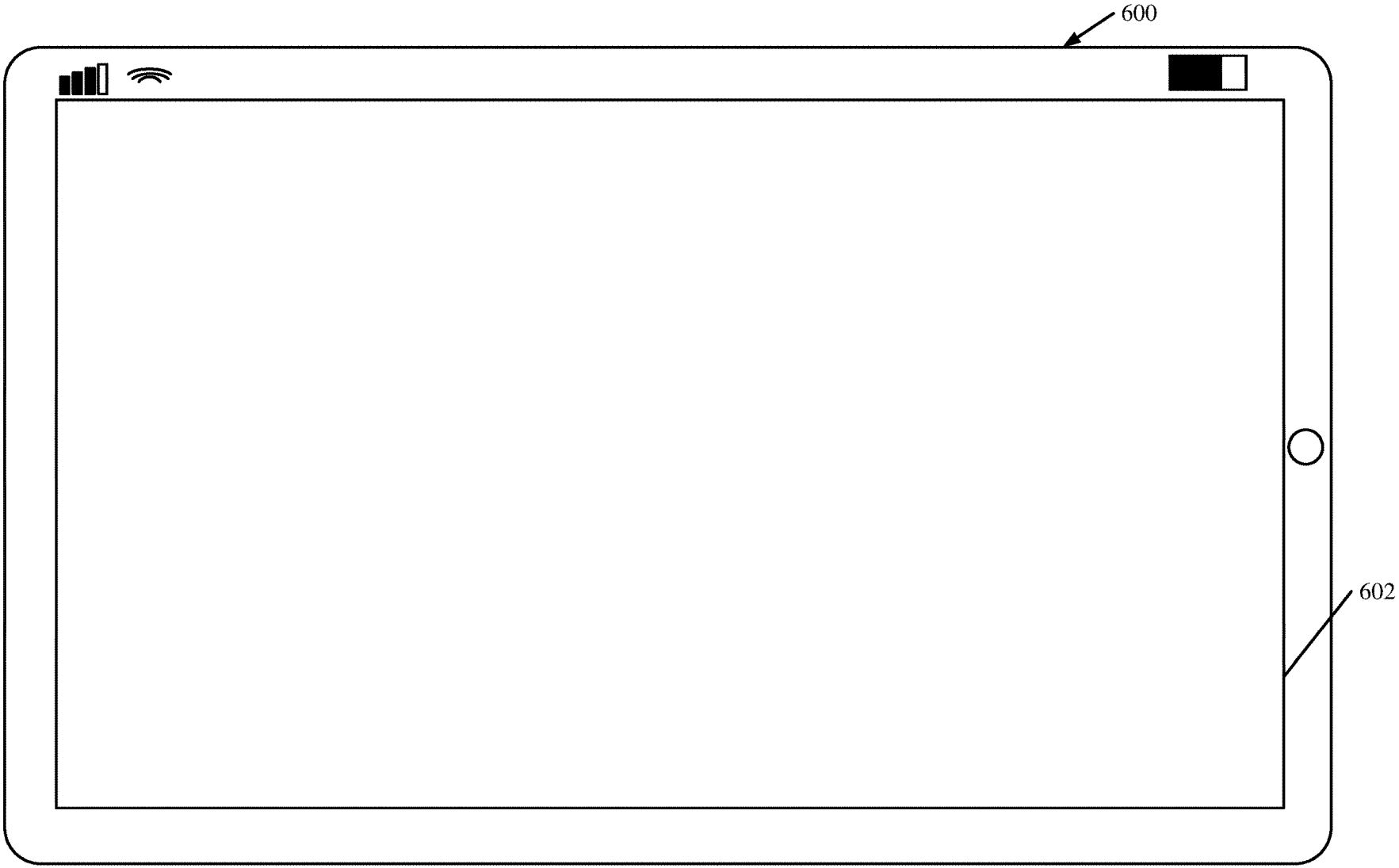
Figure 7:
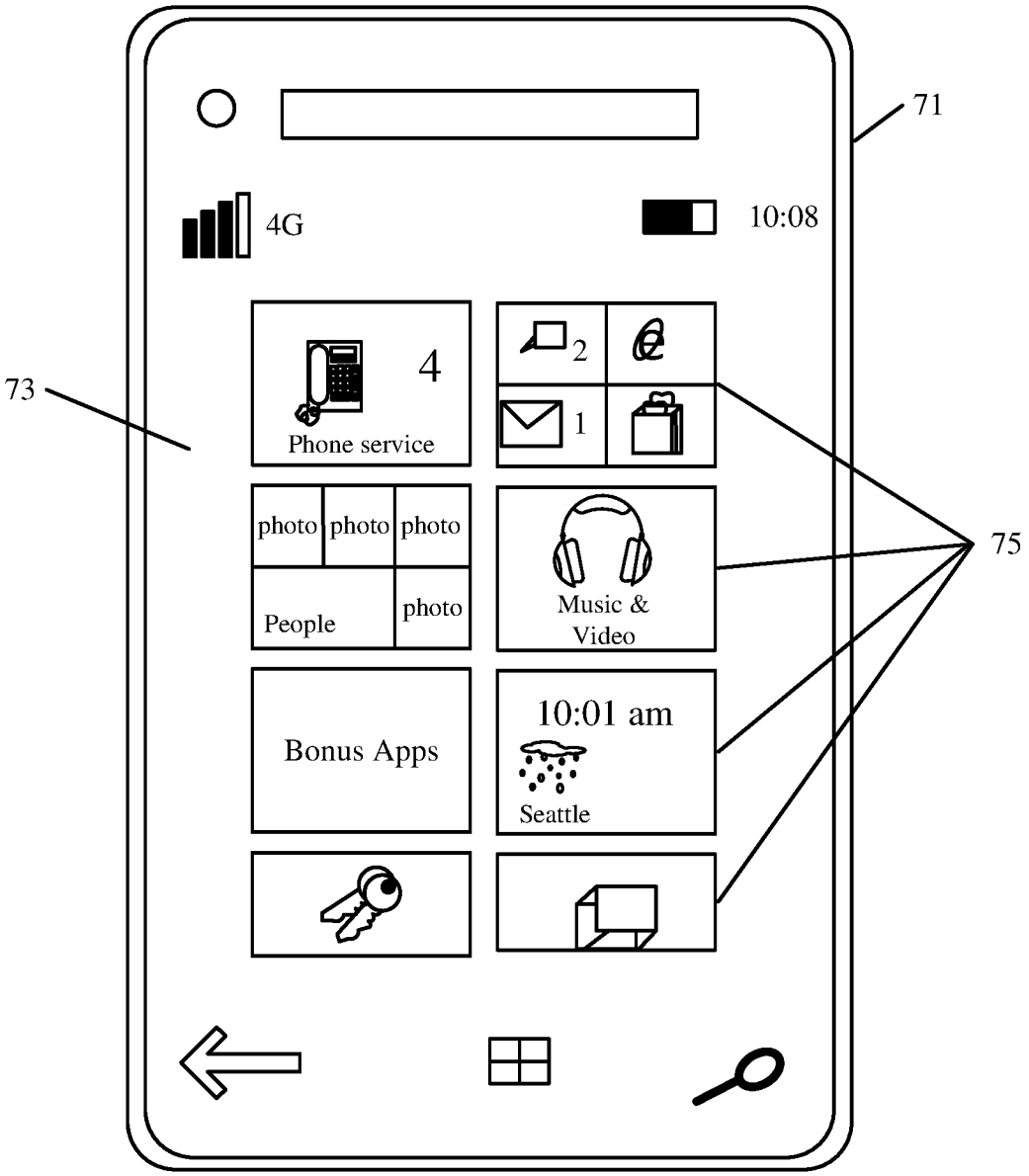

FIG. 5 is a simplified block diagram of one illustrative example of a handheld or mobile computing device that can be used as a user's or client's hand held device 16, in which the present system (or parts of it) can be deployed. For instance, a mobile device can be deployed in the operator compartment of machine 110. FIGS. 6-7 are examples of handheld or mobile devices.

FIG. 5 provides a general block diagram of the components of a client device 16 that can run some components shown in FIG. 1, that interacts with them, or both. In the device 16, a communications link 13 is provided that allows the handheld device to communicate with other computing devices and in some examples provides a channel for receiving information automatically, such as by scanning. Examples of communications link 13 include allowing communication though one or more communication protocols, such as wireless services used to provide cellular access to a network, as well as protocols that provide local wireless connections to networks.

In other examples, applications can be received on a removable Secure Digital (SD) card that is connected to an interface 15. Interface 15 and communication links 13 communicate with a processor 17 (which can also embody processors or servers from pervious FIGS.) along a bus 19 that is also connected to memory 21 and input/output (I/O) components 23, as well as clock 25 and location system 27.

I/O components 23, in one example, are provided to facilitate input and output operations. I/O components 23 for various examples of the device 16 can include input components such as buttons, touch sensors, optical sensors, microphones, touch screens, proximity sensors, accelerometers, orientation sensors and output components such as a display device, a speaker, and/or a printer port. Other I/O components 23 can be used as well.

Clock 25 illustratively comprises a real time clock component that outputs a time and date. It can also, illustratively, provide timing functions for processor 17.

Location system 27 illustratively includes a component that outputs a current geographical location of device 16. This can include, for instance, a global positioning system (GPS) receiver, a LORAN system, a dead reckoning system, a cellular triangulation system, or other positioning system. It can also include, for example, mapping software or navigation software that generates desired maps, navigation routes and other geographic functions.

Memory 21 stores operating system 29, network settings 31, applications 33, application configuration settings 35, data store 37, communication drivers 39, and communication configuration settings 41. Memory 21 can include all types of tangible volatile and non-volatile computer-readable memory devices. It can also include computer storage media (described below). Memory 21 stores computer readable instructions that, when executed by processor 17, cause the processor to perform computer-implemented steps or functions according to the instructions. Processor 17 can be activated by other components to facilitate their functionality as well.

FIG. 6 shows one example in which device 16 is a tablet computer 600. In FIG. 6, computer 600 is shown with user interface display screen 602. Screen 602 can be a touch screen or a pen-enabled interface that receives inputs from a pen or stylus. It can also use an on-screen virtual keyboard. Of course, it might also be attached to a keyboard or other user input device through a suitable attachment mechanism, such as a wireless link or USB port, for instance. Computer 600 can also illustratively receive voice inputs as well.

FIG. 7 shows that the device can be a smart phone 71. Smart phone 71 has a touch sensitive display 73 that displays icons or tiles or other user input mechanisms 75. Mechanisms 75 can be used by a user to run applications, make calls, perform data transfer operations, etc. In general, smart phone 71 is built on a mobile operating system and offers more advanced computing capability and connectivity than a feature phone.

Note that other forms of the devices 16 are possible.

Figure 8:
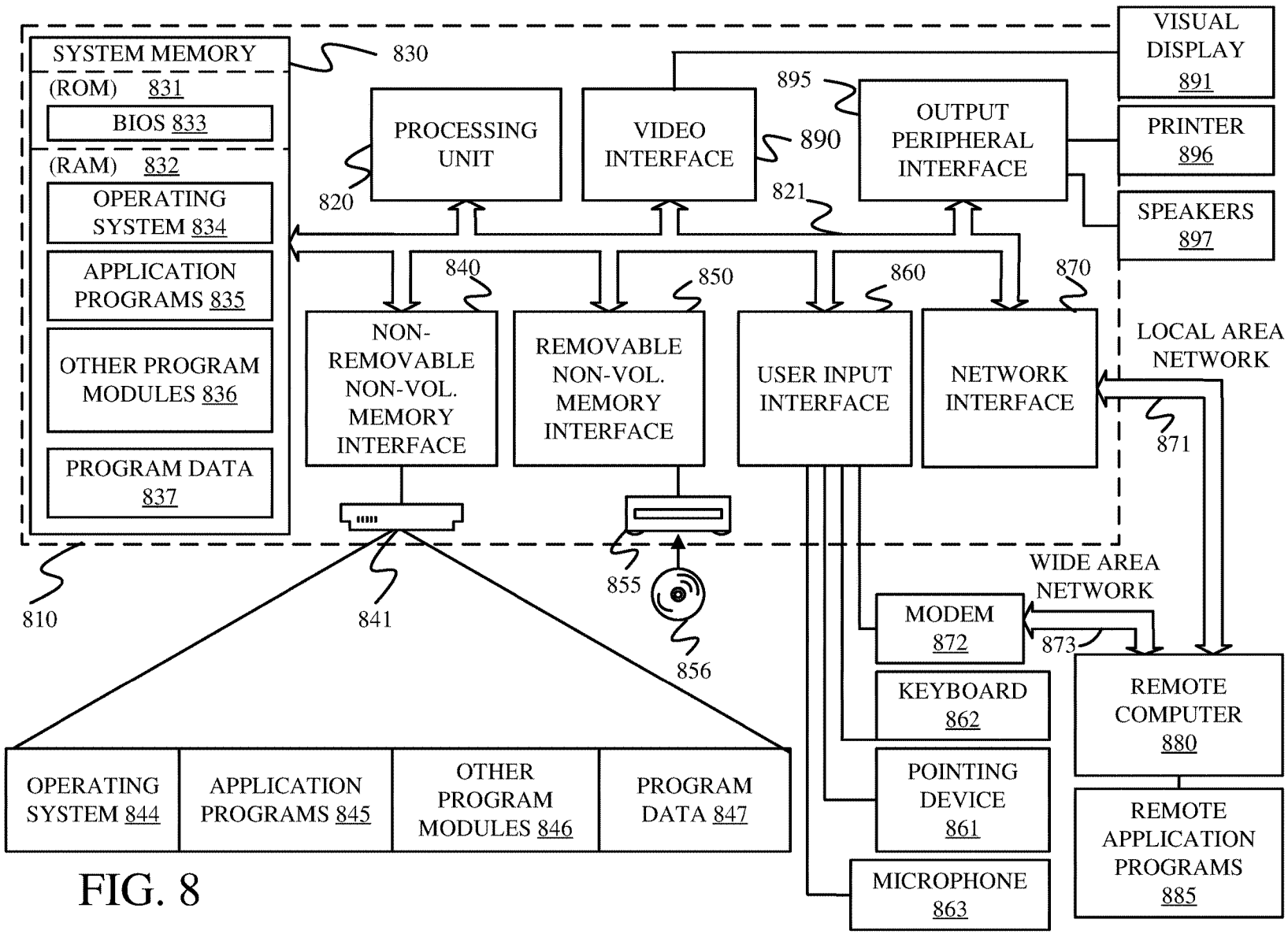
FIG. 8 is a block diagram showing one example of a computing environment that can be used in the architectures shown in the previous figures.

FIG. 8 is one example of a computing environment in which elements of FIG. 1, or parts of it, (for example) can be deployed. With reference to FIG. 8, an example system for implementing some embodiments includes a computing device in the form of a computer 810 programmed to operate as described above. Components of computer 810 may include, but are not limited to, a processing unit 820 (which can comprise processors or servers from previous FIGS.), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to FIG. 1 can be deployed in corresponding portions of FIG. 8.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 8 illustrates operating system 834, application programs 835, other program modules 836, and program data 837.

The computer 810 may also include other removable/non-removable volatile/nonvolatile computer storage media. By way of example only, FIG. 8 illustrates a hard disk drive 841 that reads from or writes to non-removable, nonvolatile magnetic media, an optical disk drive 855, and nonvolatile optical disk 856. The hard disk drive 841 is typically connected to the system bus 821 through a non-removable memory interface such as interface 840, and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 8, provide storage of computer readable instructions, data structures, program modules and other data for the computer 810. In FIG. 8, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a controller area network—CAN, a local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 8 illustrates, for example, that remote application programs 885 can reside on remote computer 880.

It should also be noted that the different examples described herein can be combined in different ways. That is, parts of one or more examples can be combined with parts of one or more other examples. All of this is contemplated herein.

Example 1 is a local operator-controlled work machine, comprising:

a controllable subsystem;

an operator interface in an operator compartment of the work machine;

a data store;

wakeup logic that generates a wakeup signal, based on an update call received from a remote machine configuration system that is located remotely from the work machine;

a configurable control system that receives the wakeup signal and powers up the operator interface on the work machine to allow remote access to the configurable control system;

operator interface control logic configured to receive new control data from the remote machine configuration system and control the operator interface to store the new control data in the data store; and a control signal generator that accesses the data store, when an operator powers up the local operator-controlled work machine and generates control signals to control the controllable subsystem based on the new control data.

Example 2 is the local operator-controlled work machine of any or all previous examples, wherein the controllable subsystem comprises a grade control system and wherein the control data comprises a job file used to control the grade control system.

Example 3 is the local operator-controlled work machine of any or all previous examples, further comprising:

a shutdown trigger detector configured detect a shutdown trigger and shutdown the work machine based on the shutdown trigger.

Example 4 is the local operator-controlled work machine of any or all previous examples, wherein the shutdown trigger detector is configured to detect, as the shutdown trigger, is a time period of non-use of the operator interface.

Example 5 is the local operator-controlled work machine of any or all previous examples, wherein the shutdown trigger detector is configured to detect, as the shutdown trigger, a shutdown control signal received from the remote machine configuration system.

Example 6 is the local operator-controlled work machine of any or all previous examples, wherein the configurable control system comprises:

a remote access system configured to facilitate remote access to the operator interface control logic using cellular communication.

Example 7 is the local operator-controlled work machine of any or all previous examples, wherein the configurable control system comprises a remote access system configured to facilitate remote access to the operator interface using satellite communication.

Example 8 is the local operator-controlled work machine of any or all previous examples, wherein the configurable control system comprises a remote access system configured to facilitate remote access to the operator interface using Wi-Fi communication.

Example 9 is the local operator-controlled work machine of any or all previous examples, wherein the configurable control system comprises a remote access system configured to facilitate remote access to the operator interface using Bluetooth communication.

Example 10 is the local operation-controlled work machine of any or all previous examples, wherein the control data comprises operating mode control data and wherein the control signal generator is configured to control the controllable subsystem based on the operating mode control data.

Example 11 is a method of controlling a local operator-controlled work machine, comprising:

wherein an operator interface in an operator compartment of the local operator-controlled work machine is powered down, receiving, at a communication system, an update call from a remote machine configuration system, located remotely from the local operator-controlled work machine;

powering up the operator interface;

facilitating remote access to the operator interface by the remote machine configuration system;

receiving control data from the remote machine configuration system through the operator interface; and when the operator interface is next powered up by an operator, controlling a controllable subsystem of the local operator-controlled work machine based on the control data.

Example 12 is the method of any or all previous examples wherein the controllable subsystem comprises a grade control system and wherein receiving control data comprises:

receiving a job plan from the remote machine configuration system and wherein controlling comprises controlling the grade control system based on the job plan.

Example 13 is the method of any or all previous examples wherein receiving control data comprises receiving machine settings and/or configuration data from the remote machine configuration system and wherein controlling comprises:

controlling the controllable subsystem based on the settings and/or configuration data.

Example 14 is the method of any or all previous examples, further comprising:

after receiving control data, detecting a shutdown signal to shutdown the work machine; and shutting down the work machine.

Example 15 is the method of any or all previous examples, wherein detecting the shutdown signal comprises:

detecting a time lapse, after receiving the control data, during which the operator interface is unused.

Example 16 is the method of any or all previous examples, wherein detecting the shutdown signal comprises:

detecting a shutdown control signal from the remote machine configuration system, after receiving the control data.

Example 17 is a local operator-controlled work machine control system, comprising:

a communication system configured to receive an update call from a remote machine configuration system when an operator interface on the local operator-controlled machine is powered down;

a configurable control system configured to power up an operator interface on the local operator-controlled work machine based on the update call;

operator interface control logic configured to control the operator interface to receive control data from the remote machine configuration system; and shutdown logic configured to power off the operator interface after the control data is received.

Example 18 is the local operator-controlled work machine control system of any or all previous examples, wherein operator interface control logic is configured to control the operator interface to receive a new job file that is used to control a grade control system.

Example 19 is the local operator-controlled work machine control system of any or all previous examples, wherein the configurable control system is configured to store the control data on the local operator-controlled work machine.

Example 20 is the local operator-controlled work machine control system of any or all previous examples, wherein the shutdown logic is configured to detect a shutdown control signal received from the remote machine configuration system and to shutdown the operator interface based on the shutdown control signal.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A local operator-controlled work machine, comprising:

a controllable subsystem;

an operator interface in an operator compartment of the work machine;

a data store;

wakeup logic that generates a wakeup signal, based on an update call received from a remote machine configuration system that is located remotely from the work machine while the local operator-controlled work machine is turned off;

a configurable control system that receives the wakeup signal and powers up the operator interface on the work machine to allow remote access to the configurable control system while the local operator-controlled work machine is turned off;

operator interface control logic configured to receive new control data from the remote machine configuration system and control the operator interface to store the new control data in the data store while the local operator-controlled work machine is turned off;

a shutdown trigger detector configured to detect a shutdown control signal received from the remote machine configuration system and to shutdown the operator interface based on the shutdown control signal while the local operator-controlled machine is turned off; and a control signal generator that accesses the data store, when an operator powers up the local operator-controlled work machine and generates control signals to control the controllable subsystem based on the new control data.

2. The local operator-controlled work machine of claim 1, wherein the controllable subsystem comprises a grade control system and wherein the control data comprises a job file used to control the grade control system.

3. The local operator-controlled work machine of claim 1, wherein the configurable control system comprises:

a remote access system configured to facilitate remote access to the operator interface control logic using cellular communication.

4. The local operator-controlled work machine of claim 1, wherein the configurable control system comprises a remote access system configured to facilitate remote access to the operator interface using satellite communication.

5. The local operator-controlled work machine of claim 1, wherein the configurable control system comprises a remote access system configured to facilitate remote access to the operator interface using Wi-Fi communication.

6. The local operator-controlled work machine of claim 1, wherein the configurable control system comprises a remote access system configured to facilitate remote access to the operator interface using Bluetooth communication.

7. The local operation-controlled work machine of claim 1, wherein the control data comprises operating mode control data and wherein the control signal generator is configured to control the controllable subsystem based on the operating mode control data.

8. A method of controlling a local operator-controlled work machine, comprising:

receiving, at a communication system, an update call from a remote machine configuration system, located remotely from the local operator-controlled work machine, while an operator interface in an operator compartment of the local operator-controlled work machine is powered down and while the local operator-controlled work machine is turned off:

powering up the operator interface in response to the update call while the local operator-controlled work machine is turned off;

facilitating remote access to the operator interface by the remote machine configuration system while the local operator-controlled work machine is turned off;

receiving control data from the remote machine configuration system through the operator interface while the local operator-controlled work machine is turned off;

detecting a shutdown control signal received from the remote machine configuration system while the local operator-controlled work machine is turned off;

powering down the operator interface, while the local operator-controlled work machine is turned off, based on the shutdown control signal;

when the local operator-controlled work machine is next turned on by an operator, controlling a controllable subsystem of the local operator-controlled work machine based on the control data.

9. The method of claim 8 wherein the controllable subsystem comprises a grade control system and wherein receiving control data comprises:

receiving a job plan from the remote machine configuration system and wherein controlling comprises controlling the grade control system based on the job plan.

10. The method of claim 8 wherein receiving control data comprises receiving machine settings and/or configuration data from the remote machine configuration system and wherein controlling comprises:

controlling the controllable subsystem based on the settings and/or configuration data.

11. A local operator-controlled work machine control system, comprising:

a communication system configured to receive an update call from a remote machine configuration system when an operator interface on the local operator-controlled machine is powered down and while the local operator-controlled machine is turned off;

a configurable control system configured to power up the operator interface on the local operator-controlled work machine based on the update call while the local operator-controlled machine is turned off;

operator interface control logic configured to control the operator interface to receive control data from the remote machine configuration system and to store the received control data on the local operator-controlled work machine while the local operator-controlled machine is turned off; and a shutdown trigger detector configured to detect a shutdown control signal received from the remote machine configuration system to power off the operator interface based on the shutdown control signal after the control data is received and while the local operator-controlled machine is turned off.

12. The local operator-controlled work machine control system of claim 11, wherein operator interface control logic is configured to control the operator interface to receive a new job file that is used to control a grade control system.

13. The local operator-controlled work machine of claim 1, wherein the controllable subsystem comprises a grade control system and wherein the control data comprises new settings used to control the grade control system.

* * * * *